US010507849B2

(12) United States Patent
Gotlund et al.

(10) Patent No.: US 10,507,849 B2
(45) Date of Patent: Dec. 17, 2019

(54) BOLSTER FOR A RAILWAY TRUCK AND METHOD FOR MANUFACTURING SAME

(71) Applicant: Nevis Industries LLC, Wilmington, DE (US)

(72) Inventors: Erik L. Gotlund, Green Oaks, IL (US); Roshan N. Manibharathi, Des Plaines, IL (US)

(73) Assignee: Nevis Industries LLC, Wilmington, DE (US)

( * ) Notice: Subject to any disclaimer, the term of this patent is extended or adjusted under 35 U.S.C. 154(b) by 370 days.

(21) Appl. No.: 15/378,738

(22) Filed: Dec. 14, 2016

(65) Prior Publication Data

US 2018/0162421 A1 Jun. 14, 2018

(51) Int. Cl.
*B61F 5/52* (2006.01)
*B61F 5/04* (2006.01)
*B61F 5/06* (2006.01)

(52) U.S. Cl.
CPC ..... *B61F 5/52* (2013.01); *B61F 5/04* (2013.01); *B61F 5/06* (2013.01)

(58) Field of Classification Search
CPC ..... B61F 5/04; B61F 5/52; B22C 9/02; B22C 9/088; B22C 9/10; B22C 9/22; B22C 9/103; B22C 9/108; B22D 25/02
USPC ..... 105/226
See application file for complete search history.

(56) References Cited

U.S. PATENT DOCUMENTS 4,114,540 A * 9/1978 Strugielski ..... B61F 5/52 105/226
4,196,672 A 4/1980 Bullock
4,342,266 A * 8/1982 Cooley ..... B61F 5/52 105/226
4,370,933 A * 2/1983 Mulcahy ..... B61F 5/06 105/198.5
5,111,753 A 5/1992 Zigler et al.
5,718,177 A * 2/1998 Wronkiewicz ..... B22C 9/10 105/206.1
5,752,564 A * 5/1998 Callahan ..... B22C 9/103 164/137
5,954,114 A * 9/1999 Bauer ..... B61F 5/52 164/137
6,089,166 A * 7/2000 Callahan ..... B61F 5/52 105/226
6,196,134 B1 * 3/2001 Stecker ..... B61F 5/04 105/199.1
6,354,226 B2 * 3/2002 Stecker ..... B61F 5/04 105/226
6,622,776 B2 * 9/2003 Bauer ..... B22C 9/103 164/137

(Continued)

FOREIGN PATENT DOCUMENTS

WO 2008070953 A1 6/2008

OTHER PUBLICATIONS

Apr. 3, 2018—(WO) International Search Report and Written Opinion—App. PCT/US2017/066427.

*Primary Examiner* — Zachary L Kuhfuss
(74) *Attorney, Agent, or Firm* — Banner & Witcoff, Ltd.

(57) ABSTRACT

A bolster used in a railway car truck that has localized areas of increased strength and method of manufacturing the bolster. The bolster may comprise a center wall near each end of the bolster with a cross-section where the center wall has a tapered thickness with the top portion of the center wall being greater than the bottom portion of the center wall.

15 Claims, 12 Drawing Sheets

(56) References Cited

U.S. PATENT DOCUMENTS

| | | | | |
|---|---|---|---|---|
| 6,662,853 | B2 * | 12/2003 | Bauer | B22C 9/103 164/137 |
| 7,631,603 | B2 * | 12/2009 | Forbes | B61F 5/32 105/157.1 |
| 7,681,506 | B2 * | 3/2010 | Forbes | B61F 5/52 105/226 |
| 9,216,450 | B2 * | 12/2015 | Gotlund | B22C 9/02 |
| 9,233,416 | B2 * | 1/2016 | Gotlund | B22C 9/02 |
| 9,346,098 | B2 * | 5/2016 | Gotlund | B22C 9/02 |
| 10,112,629 | B2 * | 10/2018 | Gotlund | B22C 9/02 |
| 2001/0008108 | A1 * | 7/2001 | Stecker | B61F 5/04 105/226 |
| 2004/0031413 | A1 | 2/2004 | Smith | |
| 2012/0291661 | A1 | 11/2012 | Gotlund et al. | |
| 2012/0291979 | A1 * | 11/2012 | Gotlund | B22C 9/02 164/137 |
| 2016/0137211 | A1 * | 5/2016 | Gotlund | B22C 9/02 164/6 |
| 2016/0207105 | A1 * | 7/2016 | Gotlund | B22C 9/02 |

* cited by examiner

BOLSTER FOR A RAILWAY TRUCK AND METHOD FOR MANUFACTURING SAME

TECHNICAL FIELD

The disclosure relates generally to a bolster for a railway car truck and more particularly to a bolster having increased strength in specified areas.

BACKGROUND

Railway cars typically consist of a rail car that rests upon a pair of truck assemblies. The truck assemblies include a pair of side frames and wheelsets connected together via a bolster and damping system. The car rests upon the bowl portion at the center of the bolster, which acts as a point of rotation for the truck system. The car body movements are reacted through the springs and friction wedge dampers, which connect the bolster and side frames. The side frames include pedestals that each define a jaw into which a wheel assembly of a wheel set is positioned using a roller bearing adapter.

The bolsters may be formed via various casting techniques. The most common technique for producing these components is through sand casting. High production manufacturing of bolsters in this casting process leaves the products susceptible to defects making the product vulnerable to high operating stresses and fatigue cycles.

The bolster may have life cycle requirements of fifty years. However, while in use, the bolster undergoes various loading situations particularly near the bowl portion and the ends where the bolster connects to the side frame. A means to reduce porosity defects will increase the strength of the bolster in these areas may extend the life cycle of the bolster,

BRIEF SUMMARY

Aspects of this disclosure relate to a bolster for a railway car truck, where the bolster may comprise a top wall, a bottom wall, a front wall, and a back wall; a first pair of shoe pockets at a first end of the bolster, where the first pair of shoe pockets are configured to be inserted into a bolster opening of a first side frame, and a second pair of shoe pockets at a second end of the bolster, where the second pair of shoe pockets are configured to be inserted into a bolster opening of a second side frame. A first center wall may be positioned toward the first end and engaged with the top wall and the bottom wall, and substantially centered between the front wall and the back wall, and a second center wall may be positioned toward the second end and engaged with the top wall and the bottom wall, and substantially centered between the front wall and the back wall. The bolster further comprises a pair of brake window openings defined in the front and back walls by brake window walls, a pair of lightener windows defined in the front and back walls by lightener window walls, and a bowl portion defined in the center of the bolster. Further, a thickness of a top portion of the first center wall may be greater than a thickness of a bottom portion of the first center wall proximate a first location between the bowl portion and the first end, and a thickness of a top portion of the second center wall may be greater than a thickness of a bottom portion of the second center wall proximate a second location between the bowl portion and the second end.

Additional aspects of this disclosure may relate to a bolster where the first location may be arranged between about 28.75 inches and 31.75 inches toward the first end from the center of the bolster; and the second location may be arranged between about 28.75 inches and 31.75 inches toward the second end from the center of the bolster. Alternatively, the center of the first riser may be arranged between about 28.25 inches and 31.25 inches toward the first end from the center of the bolster, and the center of the second riser may be arranged between about 28.25 inches and 31.25 inches toward the second end from the center of the bolster. Further, the thickness of a top portion of the first center wall proximate the first location may be between about 4.60 inches and 5.60 inches, the thickness of the bottom portion of the first center wall proximate the first location may be between about 3.51 inches and 4.51 inches, the thickness of a top portion of the second center wall proximate the second location may be between about 4.60 inches and 5.60 inches, and the thickness of the bottom portion of the second center wall proximate the second location may be between about 3.51 inches and 4.51 inches.

In addition, aspects of this disclosure may relate to a ratio of the thickness of a top portion of the first center wall proximate the first location to the thickness of the bottom portion of the first center wall proximate the first location may be between about 1.08:1 and 1.46:1, and the ratio of the thickness of a top portion of the second center wall proximate the second location to the thickness of the bottom portion of the second center wall proximate the second location may be between about 1.08:1 and 1.46:1. A thickness of a top portion of the first center wall proximate the first location may be between about 5.65 inches and 6.65 inches and the thickness of the bottom portion of the first center wall proximate the first location may be between about 3.40 inches and 4.40 inches, and a thickness of a top portion of the second center wall proximate the second location may be between about 5.65 inches and 6.65 inches and the thickness of the bottom portion of the second center wall proximate the second location may be between about 3.40 inches and 4.40 inches. The ratio of the thickness of a top portion of the first center wall proximate the first location to the thickness of the bottom portion of the first center wall proximate the first location may be between about 1.34:1 and 1.81:1. The ratio of the thickness of a top portion of the second center wall proximate the second location to the thickness of the bottom portion of the second center wall proximate the second location may be between about 1.34:1 and 1.81:1.

Still other aspects of this disclosure may relate to a bolster where a thickness of a top portion of the first center wall proximate the first location may be between about 4.45 inches and 5.45 inches and the thickness of the bottom portion of the first center wall proximate the first location may be between about 2.42 inches and 3.42 inches, and wherein a thickness of a top portion of the second center wall proximate the second location may be between about 4.45 inches and 5.45 inches and the thickness of the bottom portion of the second center wall proximate the second location may be between about 2.42 inches and 3.42 inches. The ratio of the thickness of a top portion of the first center wall proximate the first location to the thickness of the bottom portion of the first center wall proximate the first location may be between about 1.44:1 and 1.95:1. The ratio of the thickness of a top portion of the second center wall proximate the second location to the thickness of the bottom portion of the second center wall proximate the second location may be between about 1.44:1 and 1.95:1.

Yet other aspects of this disclosure may relate to a bolster where a thickness of an inner portion of the bottom wall proximate the first location may be greater than the thickness of an outer portion of the bottom wall proximate the first location, and wherein a thickness of an inner portion of the bottom wall proximate the second location may be greater than the thickness of an outer portion of the bottom wall proximate the second location. In addition, a thickness of an inner portion of the bottom wall proximate the first location may be between about 2.10 inches and 2.60 inches and the thickness of an outer portion of the bottom wall proximate the first location may be between about 0.85 inches and 1.35 inches, and a thickness of an inner portion of the bottom wall proximate the second location may be between about 2.10 inches and 2.60 inches and the thickness of an outer portion of the bottom wall proximate the first location may be between about 0.85 inches and 1.35 inches. The ratio of the thickness of an inner portion of the bottom wall proximate the first location to the thickness of an outer portion of the bottom wall proximate the first location may be between about 1.82:1 and 2.46:1, and the ratio of the thickness of an inner portion of the bottom wall proximate the second location to the thickness of an outer portion of the bottom wall proximate the second location may be between about 1.82:1 and 2.46:1. A thickness of an inner portion of the bottom wall proximate the first location may be between about 1.44 inches and 1.94 inches and the thickness of an outer portion of the bottom wall proximate the first location may be between about 1.18 inches and 1.68 inches; and a thickness of an inner portion of the bottom wall proximate the second location may be between about 1.44 inches and 1.94 inches and the thickness of an outer portion of the bottom wall proximate the first location may be between about 1.18 inches and 1.68 inches. The ratio of the thickness of an inner portion of the bottom wall proximate the first location to the thickness of an outer portion of the bottom wall proximate the first location may be between about 1.05:1 and 1.36:1, and the ratio of the thickness of an inner portion of the bottom wall proximate the second location to the thickness of an outer portion of the bottom wall proximate the second location may be between about 1.05:1 and 1.36:1.

Still further aspects of this disclosure may relate to a bolster where a thickness of an inner portion of the bottom wall proximate the first location may be between about 2.06 inches and 2.56 inches and the thickness of an outer portion of the bottom wall proximate the first location may be between about 1.73 inches and 2.23 inches, and a thickness of an inner portion of the bottom wall proximate the second location may be between about 2.06 inches and 2.56 inches and the thickness of an outer portion of the bottom wall proximate the first location may be between about 1.73 inches and 2.23 inches. Also, the ratio of the thickness of an inner portion of the bottom wall proximate the first location to the thickness of an outer portion of the bottom wall proximate the first location may be between about 1.05:1 and 1.35:1, and the ratio of the thickness of an inner portion of the bottom wall proximate the second location to the thickness of an outer portion of the bottom wall proximate the second location may be between about 1.05:1 and 1.35:1.

Other aspects of this disclosure a bolster for a railway car truck may comprise a top wall, a bottom wall, a front wall, a back wall, a first pair of shoe pockets at a first end of the bolster, and a second pair of shoe pockets at a second end of the bolster. The bolster may also include a first center wall positioned toward the first end and engaged with the top wall and the bottom wall, and substantially centered between the front wall and the back wall, a second center wall positioned toward the second end and engaged with the top wall and the bottom wall, and substantially centered between the front wall and the back wall, a pair of brake window openings defined in the front and back walls by brake window walls, a pair of lightener windows defined in the front and back walls by lightener window walls, and a bowl portion defined in the center of the bolster. The thickness of a top portion of the first center wall may be greater than a thickness of a bottom portion of the first center wall, and a thickness of a top portion of the second center wall may be greater than a thickness of a bottom portion of the second center wall. Also, the thickness of the bottom wall adjacent the first center wall may be greater than the thickness of the bottom wall adjacent the front wall and the back wall; and a thickness of the bottom wall adjacent the second center wall may be greater than the thickness of the bottom wall adjacent the front wall and the back wall. The ratio of the thickness of the top portion of the first center wall to the thickness of the bottom portion of the first center wall may be between about 1.08:1 and 1.95:1, and the ratio of the thickness of the top portion of the second center wall to the thickness of the bottom portion of the second center wall is between about 1.08:1 and 1.95:1.

Other aspects of this disclosure may relate to a bolster where the ratio of the thickness of the bottom wall adjacent the first center wall to the thickness of the thickness of the bottom wall adjacent the front wall and the back wall may be between about 1.05:1 and 2.46:1, and the ratio of the thickness of the bottom wall adjacent the second center wall to the thickness of the thickness of the bottom wall adjacent the front wall and the back wall may be between about 1.05:1 and 2.46:1.

Lastly, aspects of this disclosure may relate to a bolster for a railway car truck may comprise a top wall, a bottom wall, a front wall, a back wall, a first pair of shoe pockets at a first end of the bolster, a second pair of shoe pockets at a second end of the bolster, a first center wall positioned toward the first end and engaged with the top wall and the bottom wall, and substantially centered between the front wall and the back wall; a second center wall positioned toward the second end and engaged with the top wall and the bottom wall, and substantially centered between the front wall and the back wall, and a bowl portion defined in the center of the bolster. The thickness of the bottom wall adjacent the first center wall may be greater than the thickness of the bottom wall adjacent the front wall and the back wall, and a thickness of the bottom wall adjacent the second center wall may be greater than the thickness of the bottom wall adjacent the front wall and the back wall.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. The reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Proximate" as used herein, means that a first feature is located within a range +/−1 inch of a second feature.

"Substantially constant" as used herein, when referring to a dimension means that a value is approximately the same and varies no more than +/−5%.

Figure 1A:
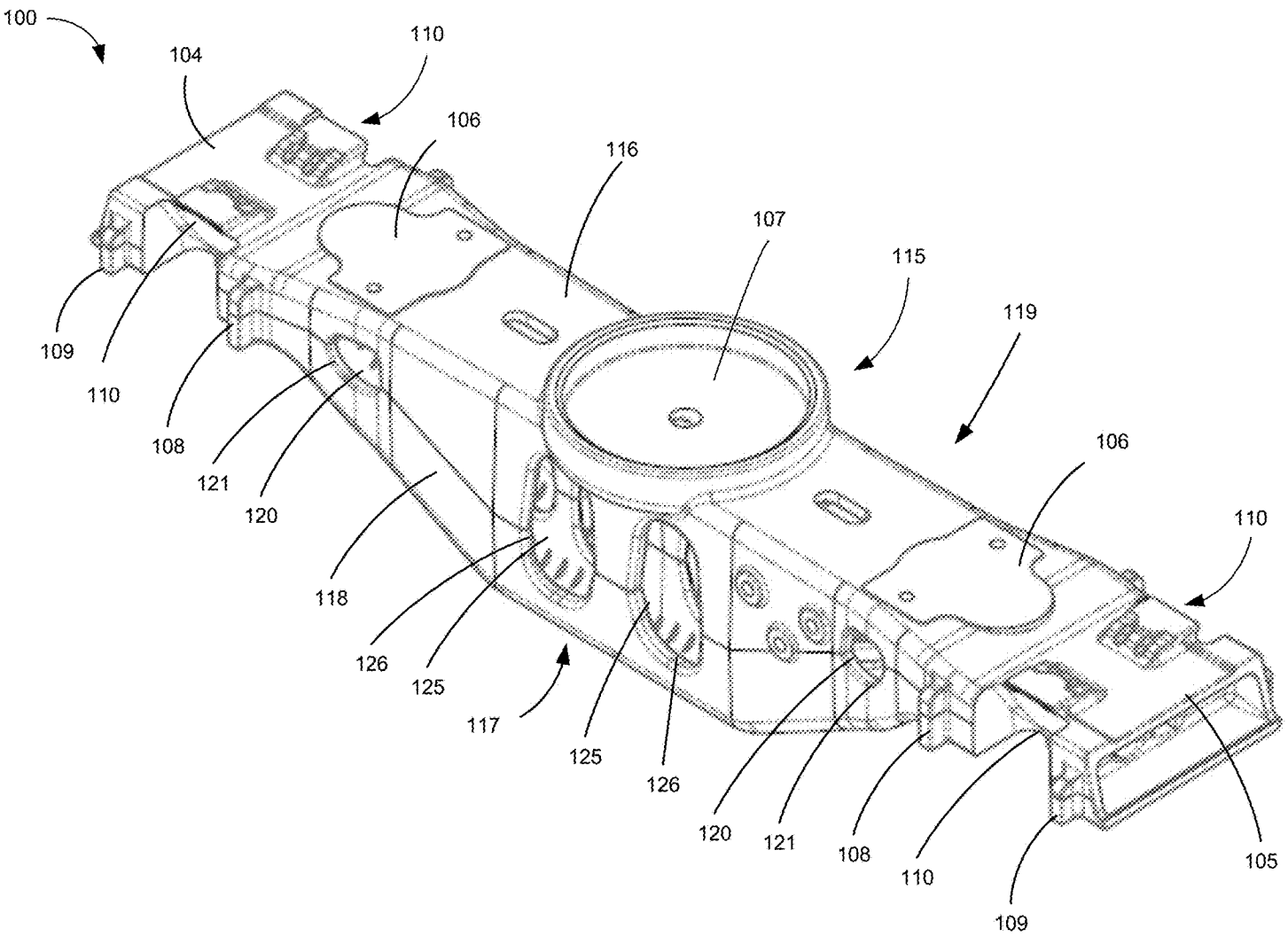
FIG. 1A illustrates a perspective view of an exemplary bolster for a 70 ton capacity truck as described in this disclosure.
Figure 1B:
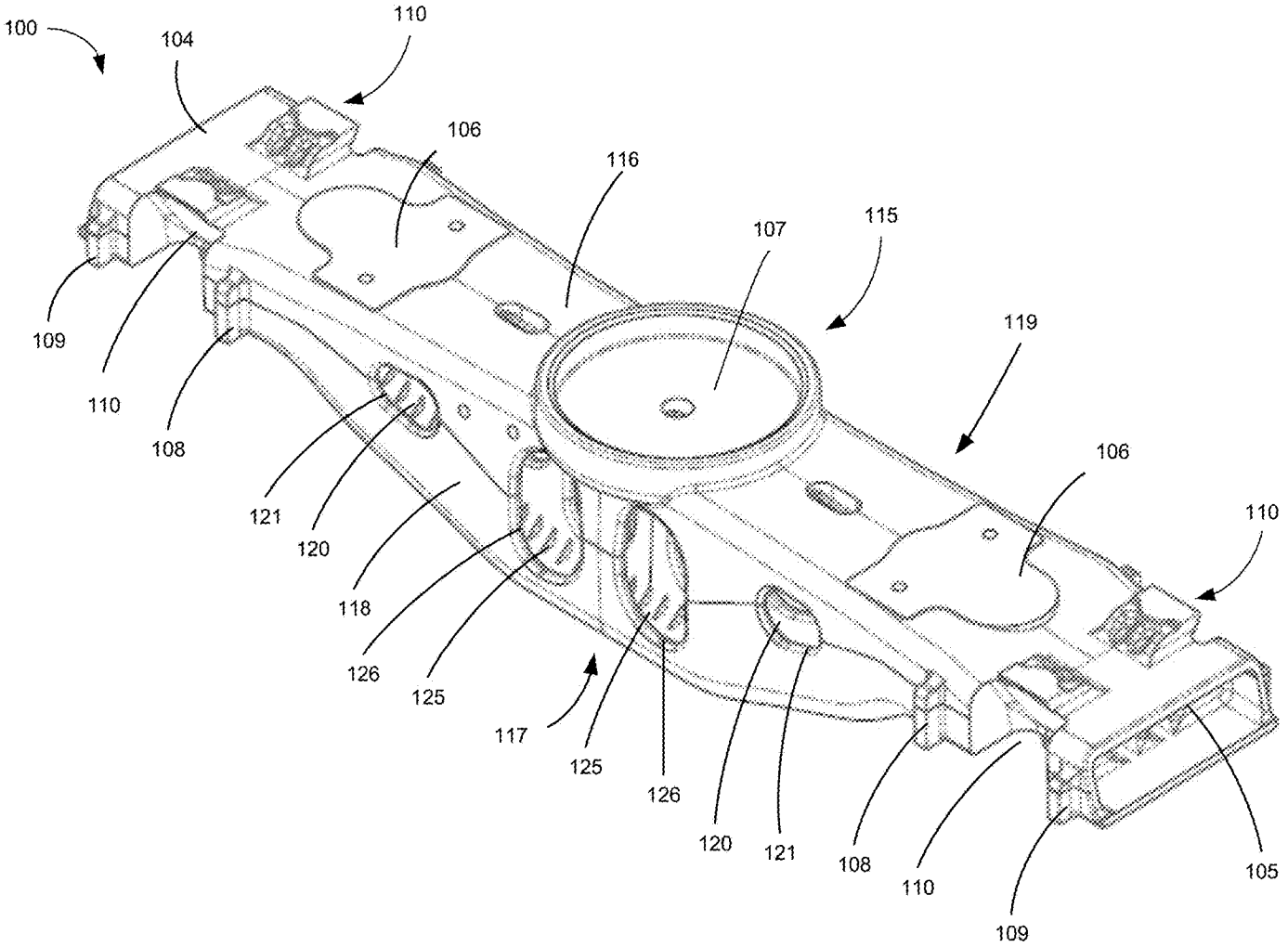
FIG. 1B illustrates a perspective view of an exemplary bolster for a 110 ton capacity truck as described in this disclosure.
Figure 1C:
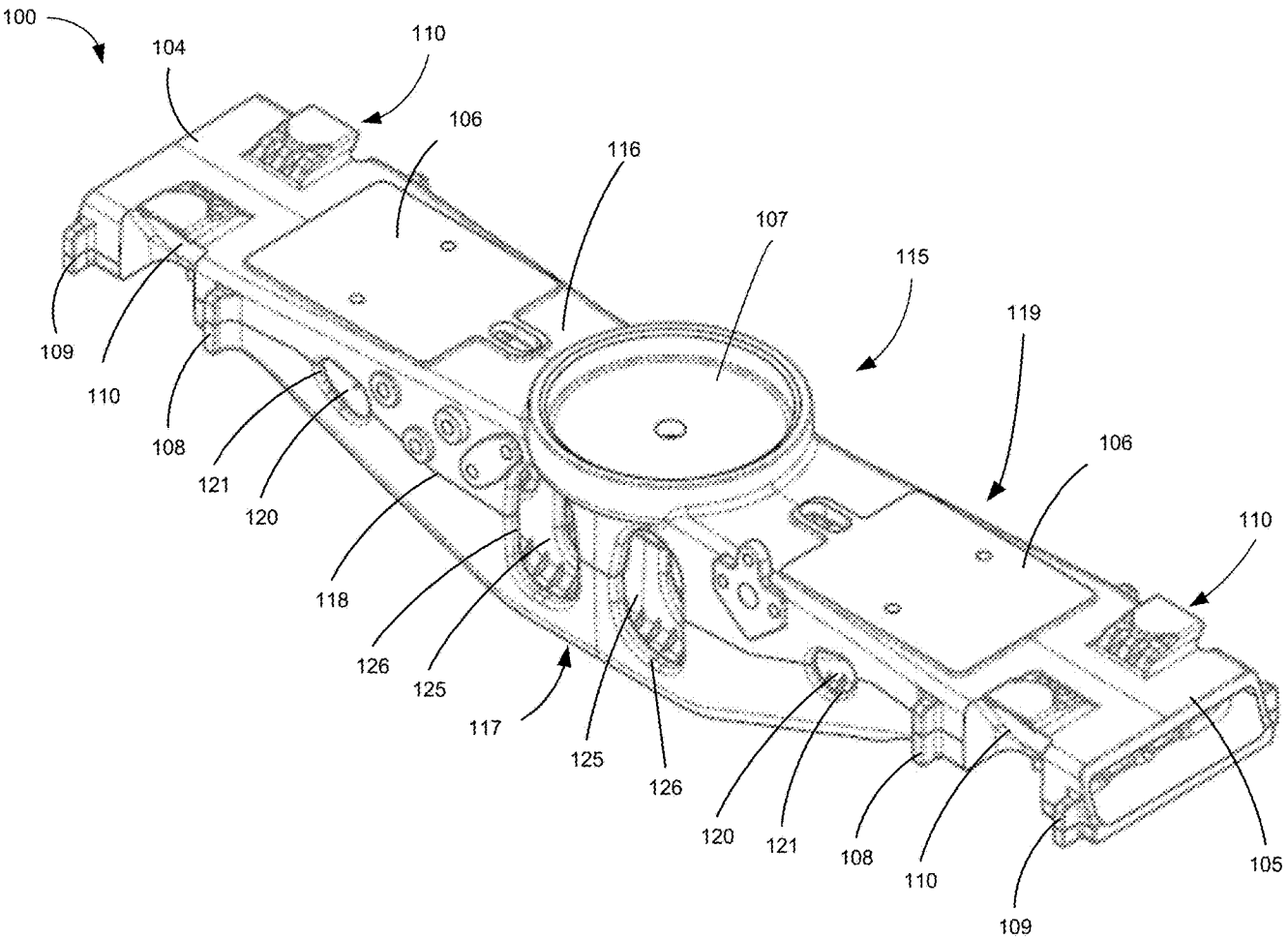
FIG. 1C illustrates a perspective view of an exemplary bolster for a 125 ton capacity truck as described in this disclosure.
Figure 2:
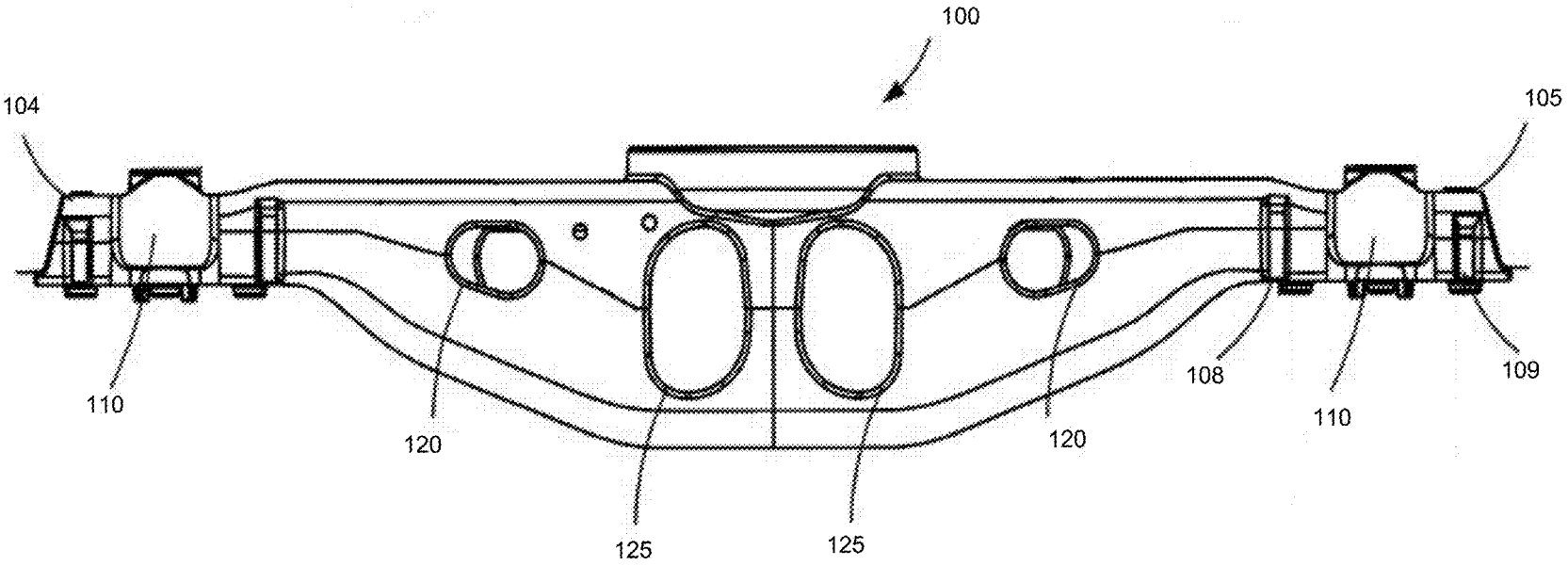
FIG. 2 illustrates a side view of the exemplary bolster.

FIGS. 1 and 2 illustrate an exemplary bolster 100 that may be utilized in combination with a side frame (not shown) as part of a truck for a railway car. The bolster 100 includes a main body section 115 having a top wall 116, a bottom wall 117, a front wall 118, and a back wall 119 along with first and second end sections 104, 105. The main body section 115 defines a bowl portion 107 located in the center of top wall 116 upon which a rail car rests. A pair of brake window openings 125 may be defined in the front and back walls 118, 119 by brake window walls 126. A pair of lightener windows 120 may be defined in the front and back walls 118, 119 by lightener window walls 121. The bolster 100 may also include a pair of center walls 127, 128 (both not shown in FIGS. 1 and 2) with one positioned toward the first end 104 and another positioned toward the second end 105 that are both engaged with the top wall 116 and the bottom wall 117 and substantially centered between the front wall 118 and the back wall 119. The first and second end sections 104, 105 are configured to be coupled to a pair of side frames (not shown). Specifically, each end section 104, 105 is positioned within the bolster opening of a side frame (not shown) and defines a pair of side bearing pads 106 that are positioned below a bearing surface of a rail car. The first and second end sections 104, 105 may each include a pair of shoe pockets 110. A pair of inner and outer gibs 108, 109 may be positioned on each side of the shoe pockets 110.

As described above, the main body section 115 of the bolster 100 may define a pair of brake window openings 125 configured to enable the use of brake rigging. These windows may also act as core prints to support the core in the mold when manufacturing the bolster 100.

Figure 3:
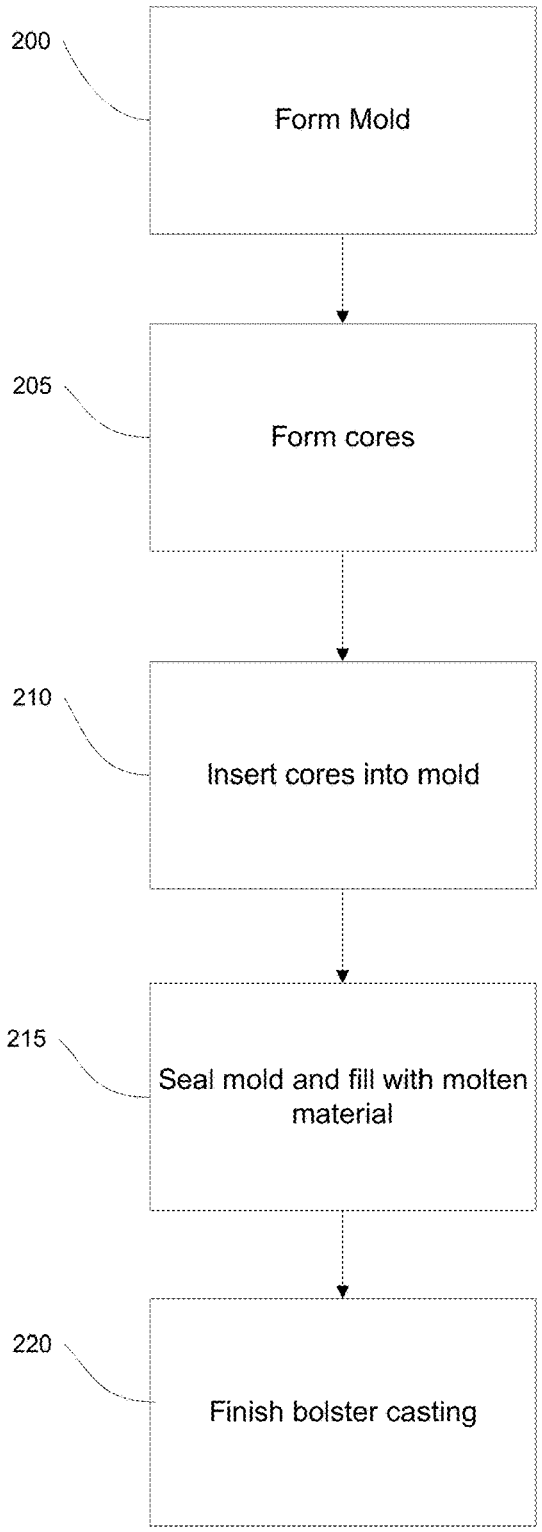
FIG. 3 illustrates exemplary operations for manufacturing a bolster.

FIG. 3 illustrates exemplary operations for manufacturing the bolster 100 described above.

At block 200, a mold for manufacturing the bolster 100 may be formed. The mold may include a first or drag portion and a second or cope portion. The first or drag portion of the mold may include a cavity formed in the shape of the first or drag side of the bolster 100. The second or cope portion may include a cavity formed in the shape of the second or cope side of the bolster 100.

The respective portions may be formed by first providing first and second patterns that define an outside perimeter of the first or drag side and second or cope side, respectively, of the bolster 100. The patterns may partially define one or more feed paths for distribution of molten material within the mold.

The mold may also include a plurality of risers that are integrally formed with the bolster 100 when the molten material fills the mold. The risers may be hollow cylindrical structures into which molten material fills during casting operations. The risers may be positioned at areas of the mold that correspond to thicker areas of the side frame that cool more slowly than other areas of the bolster. The risers function as reservoirs of molten material that compensate for contraction that occurs in the molten material as the molten material cools, and thus may prevent shrinkage, or hot tearing of the cast bolster in the thicker areas that might otherwise occur. The risers may be formed in the pattern or may be placed in the pattern before molding. Additionally, the risers may have any shape such as a tubular shape, elliptically shaped, side feeding, or conical shaped. Risers may be created from a material which insulates heat, or exothermic material which generates heat, or formed in the same material as the mold. As another option, the risers may be vented to the atmosphere or blind where they are not vented to the atmosphere. Exemplary risers 160, 162 are illustrated on bolster 100 in FIGS. 5, 6A, 7A, and 8A.

Figure 4A:
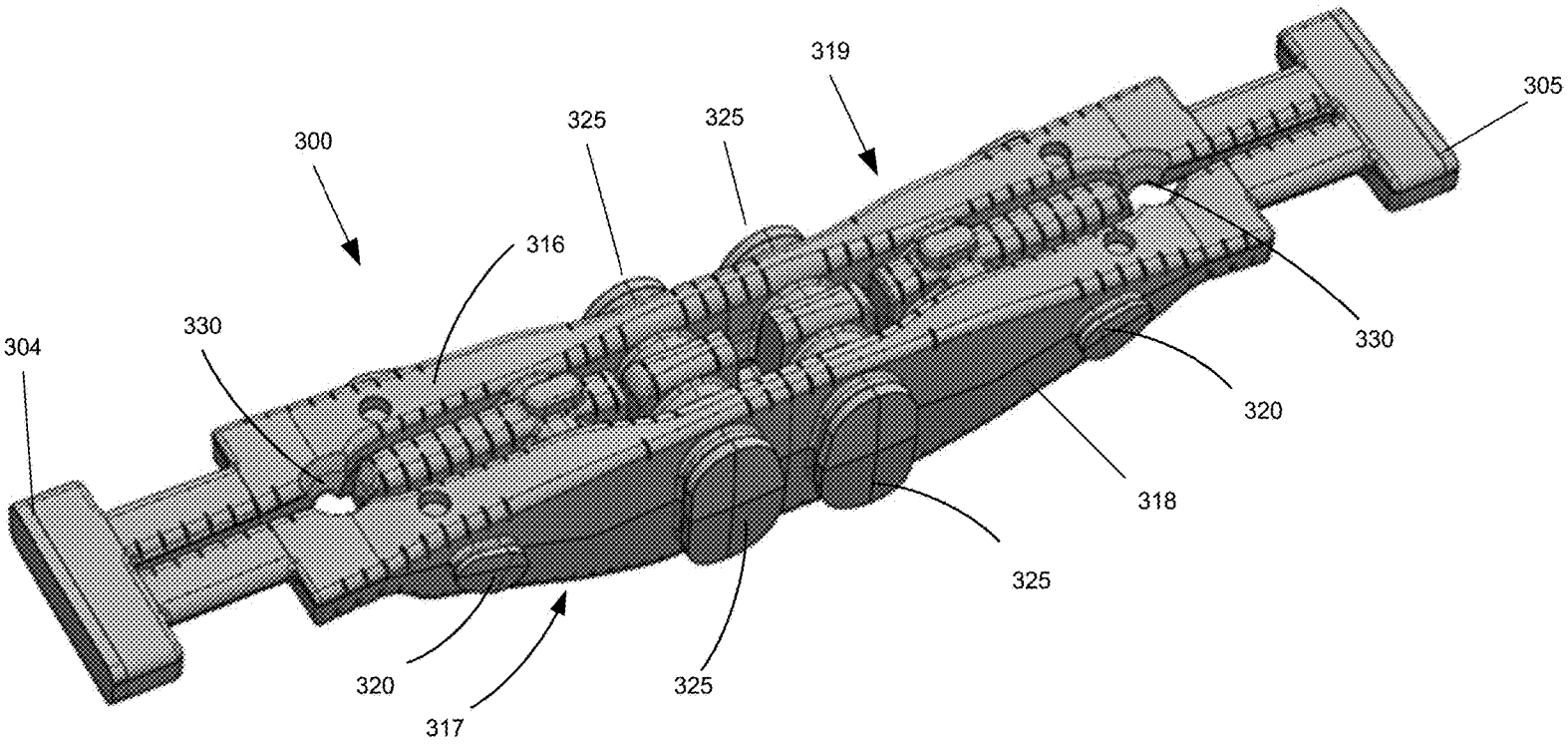
FIG. 4A illustrates an perspective view of an exemplary core for manufacturing a bolster.
Figure 4B:
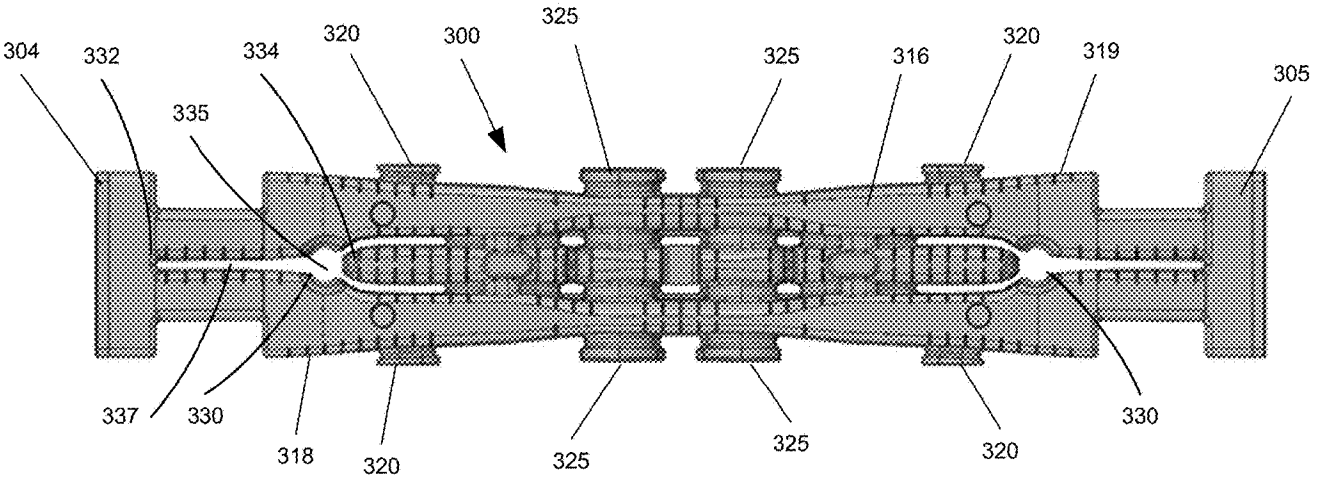
FIG. 4B illustrates a top view of the exemplary core of FIG. 4A.
Figure 4C:
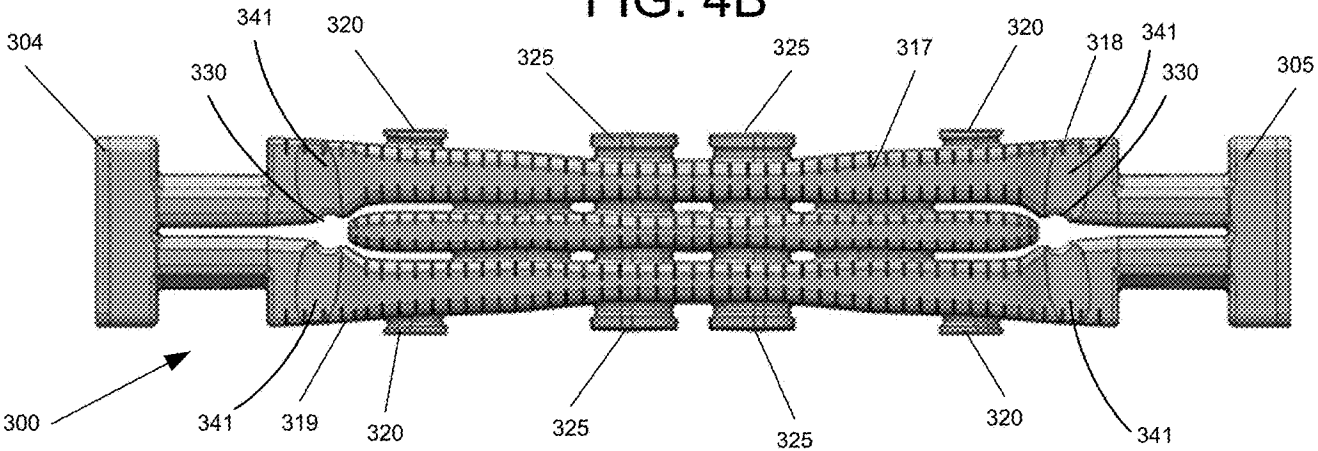
FIG. 4C illustrates a bottom view of the exemplary core of FIG. 4A.

At block 205, a bolster core 300 that defines the interior region of the bolster 100, as shown in FIGS. 4A-4C, is formed. The bolster core 300 may include one or more portions. For example, the bolster core 300 may include a first end 304, a second end 305, a top surface 316, a bottom surface 317, a front surface 318, and a back surface 319. These surfaces in conjunction with the mold may define the thicknesses of the top wall 116, bottom wall 117, front wall 118, and back wall 119. The bolster core 300 further defines a pair of brake window opening cores 325 and a pair of lightener window cores 320 protruding from each of the front and back surfaces 318, 319. Additionally, the bolster core 300 may define a pair of center wall portions 330 with one positioned toward the first end 304 and another positioned toward the second end 305 that are defined by openings between the top surface 316 and the bottom surface 317 that are substantially centered between the front surface 318 and the back surface 319. The pair of center wall portions 330 allow for the center wall to extend from the top wall 116 to the bottom wall 117 of the bolster 100. Also, each center wall portion 330 may include an outboard end 332 and an inboard end 334. The center wall portion 330 may also comprise a rounded portion 335 near the inboard end 334 and a tapered elongated portion 337 extending from the rounded portion 335 to the outboard end 332, where the rounded portion 335 may have a greater width than any width of the tapered elongated portion 337. Additionally, the bolster core 300 may include the bottom surface 317 may include a plurality of pockets 341. These pockets may provide for a localized variable thickness for the bottom wall 117. Although the bolster core 300 is shown in FIGS. 4A-4C as a single core, in other embodiments the bolster core 300 may comprise a plurality of engaged cores.

The bolster core 300 may be formed by any known method. In one example, the bolster core 300 may be formed by a corebox that includes a cope and drag portions that define the bolster core 300. Molding sand may be inserted into the core box and cured. The core box may then be removed to reveal the cured core. The bolster core 300 may be formed individually, integrally, or in some combination thereof. The bolster core 300 may be formed as two portions. For example, bolster core 300 may include a cope portion and a drag portion formed separately in separate core boxes (i.e., a cope mold and drag mold). After curing, the formed portions may be attached. For example, the cope and drag portions of a given core may be glued together to form the bolster core 300.

At block 210, the bolster core 300 may be inserted in the mold and the bolster 100 is cast. For example, the bolster core 300 may be inserted into the first or drag portion of the mold. The second or cope portion may be placed over the first portion and secured to the first portion via clamps, straps, and the like. In this regard, locating features may be formed in the first portion and the second portion to ensure precise alignment of the respective portions.

At block 215, after securing the respective portions, molten material, such as molten steel, may be poured into the mold. The molten material may flow through the gating and throughout the mold in the space between the mold and the bolster core 300. The bolster 100 may be formed from a carbon steel alloy that meets or exceeds the American Association of Railroads (AAR) Manual of Standards and Recommended Practices (MSRP), Specification M-201 (Dated Jan. 21, 2016), which is incorporated by reference, Grade B+ or alternatively meeting a Grade B, Grade C or similar steel alloy. Optionally, this same specification would apply if the bolster 100 is cast from a ductile iron.

The risers 160, 162 may be optimized in size to provide an optimal amount of feeding material during solidification of the molten material to prevent the formation of shrinkage voids and hot tears in critical areas of the bolster 100. Although, the risers may have any shape, the center wall risers 160 may be exothermic blind risers having a generally truncated conical shape, while the bowl risers 162 may have a generally cylindrical shape. The risers 160, 162 combined with the localized geometry of the bolster 100 around the risers 160, 162 may encourage directional solidification within the bolster 100 where the molten material begins to solidify in the regions of lowest temperature which may be furthest away from the feed and riser locations and then solidification of the molten material moves in a direction toward the regions of highest temperature which may be nearest the feed and riser locations. As the molten material solidifies in a dendritic manner toward the riser locations, the molten material that solidifies last may contain regions of increased shrinkage and porosity compared to the regions that solidified first. Thus, the risers 160, 162 combined with the localized geometry of the bolster 100 around the risers 160, 162 may create localized regions of increased solidity, reduced porosity, and improved strength within the regions of the casting where the molten material solidified first compared to the regions where the molten material solidified last nearest or within the risers 160, 162. Accordingly, the bolster 100 may comprise localized regions of greater solidity, reduced porosity, and increased strength shown as the darkened regions "S," which are fed by the risers 160, 162 shown in FIGS. 6A, 7A, and 8A.

The bolster 100 may be x-rayed, ultrasonically tested, CT scanned, or examined using other non-destructive test methods to quantify the size of defects present in the casting. X-rays may be taken in accordance with ASTM E94-04 (2010) "Standard Guide for Radiographic Examination," which is incorporated by reference, or other methods of examination. The radiographic films may be graded and examined in accordance with ASTM E446-15 "Standard Reference Radiographs for Steel Castings Up to 2 in. (50.8 mm) in Thickness," or ASTM E186-15 "Standard Reference Radiographs for Heavy-Walled (2 to 412 in. (50.8 to 114 mm)) Steel Castings," which are both incorporated by reference. Using the dimensions contained herein in concert with the risers to feed the sections consistently results in maximum shrinkage defect sizes of in accordance with a Level 2. In most cases, shrinkage defects are less than Level 1 when compared to AAR MSRP M-210 (Dated 2013) criteria, which is incorporated by reference, the solidity standard may meet or exceed Class 1.

At block 220, the bolster 100 is removed from the mold, and the bolster 100 is finished. For example, any solidified material in the gating or risers may be removed. In some implementations, the mold may be configured so that a wedge or recess is formed in riser material just beyond an exterior surface of the bolster 100. The wedge or recess may enable hammering the riser material off, rather than more time consuming flame cutting utilized in known casting operations.

Figure 5:
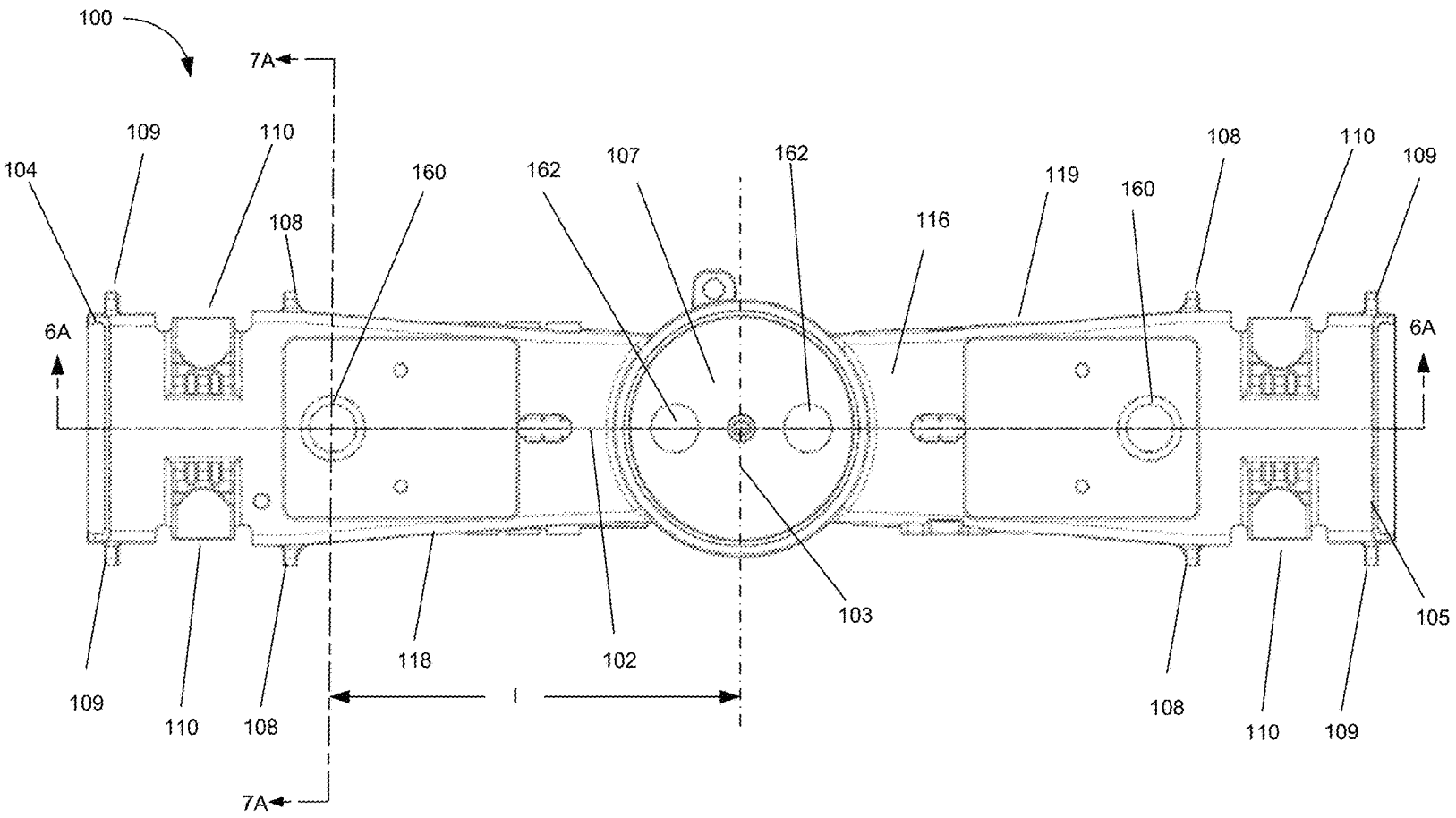
FIG. 5 illustrates a top view of the exemplary bolster.

FIGS. 5, 6A, 7A, and 8A illustrate the bolster 100 in a partial as cast condition. The term "as cast" refers to the bolster 100 as the part is removed from the mold while still having risers and other features that are removed prior to the use of the bolster 100 on the railway car or lacking additional features (such as machined holes or surfaces) needed for use on the railway car. FIG. 5 shows the center wall risers 160 which may comprise a first center wall riser 160 arranged on a top surface of the top wall 116 of the bolster 100 between the bowl portion 107 and the first end 104 and a second center wall riser 160 arranged on a top surface of the top wall 116 of the bolster 100 between the bowl portion 107 and the first end 104 and a second end 105. Further, the center wall risers 160 may be positioned over the center walls 130. The center wall risers 160 may be centered substantially over the longitudinal centerline 102 of the bolster 100 and proximate or adjacent the location of an inboard end 134 of the center wall 130. Additionally, one or more bowl risers 162 may arranged on the top surface of the bowl portion 107.

Figure 6A:
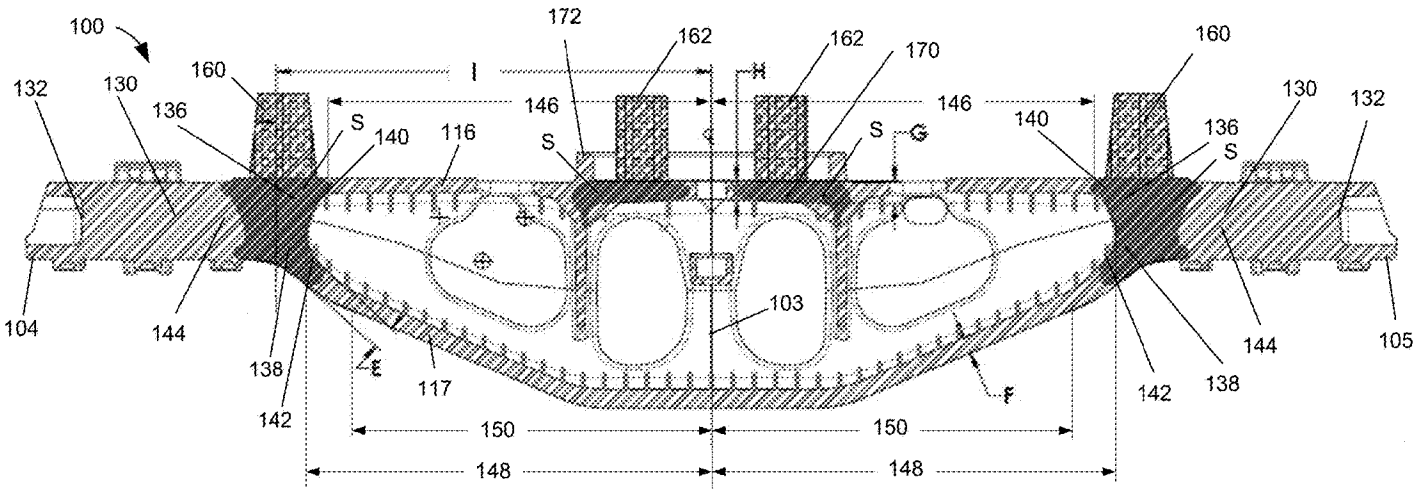
FIG. 6A illustrates a longitudinal cross-section of the exemplary bolster of FIG. 5 along line 6A-6A.
Figure 6B:
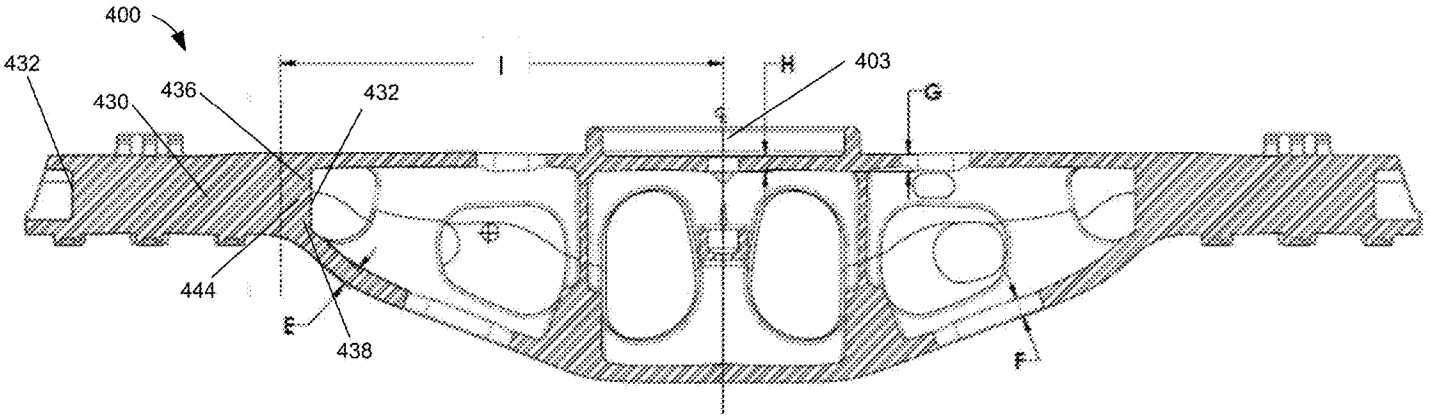
FIG. 6B illustrates a longitudinal cross-section of a prior art bolster.

FIG. 6A illustrates a longitudinal cross-sectional view of bolster 100 of FIG. 5, while FIG. 6B illustrates a similar cross-section of a prior art bolster. The cross-section of FIG.

6A shows the center wall 130 positioned near each of the first and second ends 104, 105. Each center wall 130 may comprise an outboard end 132, an inboard end 134, a top portion 136 connecting to the top wall 116, and a bottom portion 138 connecting to the bottom wall 117. Each center wall 130 may further comprise a top inboard transition 140 where the top portion 136 connects to the top wall 116 on the inboard end 134, and a bottom inboard transition 142 where the bottom portion 138 connects to the bottom wall 117 on the inboard end 134. The top inboard transition 140 gradually extends from a center portion 144 of the inboard end 134 of the center wall 130 to the interior surface of the top wall 116 such that longitudinal distance 146 from the intersection of the top inboard transition 140 and the interior surface of the top wall 116 to the lateral centerline 103 of the bolster 100 may be less than the longitudinal distance 148 from the center portion 144 of the inboard end 134 to the lateral centerline 103 of the bolster 100. Similarly, the bottom inboard transition 142 extends from a center portion 144 of the inboard end 134 of the center wall 130 to the interior surface of the bottom wall 117 such that the intersection of the bottom inboard transition 142 and the interior surface of the bottom wall 117 is a longitudinal distance 150 that may be less than the longitudinal distance 148 to the lateral centerline 103 of the bolster 100 than the center portion 144 of the inboard end 134. The bottom inboard transition 142 may have a center portion thickness, dimension "E." located at longitudinal distance 148 and gradually taper to a substantially constant bottom wall thickness, dimension "F." beginning at longitudinal distance 150, where the center portion thickness, dimension "E." is greater than the constant bottom wall thickness, dimension "F." The bottom inboard transition thickness may also be expressed as a ratio of the center portion thickness, dimension "E," to the constant bottom wall thickness, dimension "F."

Further, the wall 170 of the bowl portion 107 may have a variable thickness. For example, the thickness of wall 170 of the bowl portion 107 proximate or adjacent the pair of bowl risers 162 and near the outer wall 172 of the bowl portion 107 may have a thickness, dimension "G," while the thickness of wall 170 near the center of the bowl portion may have a thickness, dimension "H," where the thickness, dimension "G," is greater than the thickness, dimension "H." These areas of variable thickness may be proximate or adjacent the locations of the bowl riser 162. Optionally, the bowl portion 107 may comprise two pair of bowl risers 162.

The prior art bolster 400 illustrated in FIG. 6B, is described using reference numbers "4*xx*" to describe similar features of the embodiment described above using reference numbers "1*xx*". Thus, the reference numbers "4*xx*" may not be described fully or not at all. As shown in FIG. 6B, the center rib 430 has a substantially vertical inboard end 434, where the center portion 444, the top portion 436 and the bottom portion 438 of the outboard end 434 are equidistant to the lateral centerline 403 of the bolster 400.

Figure 7A:
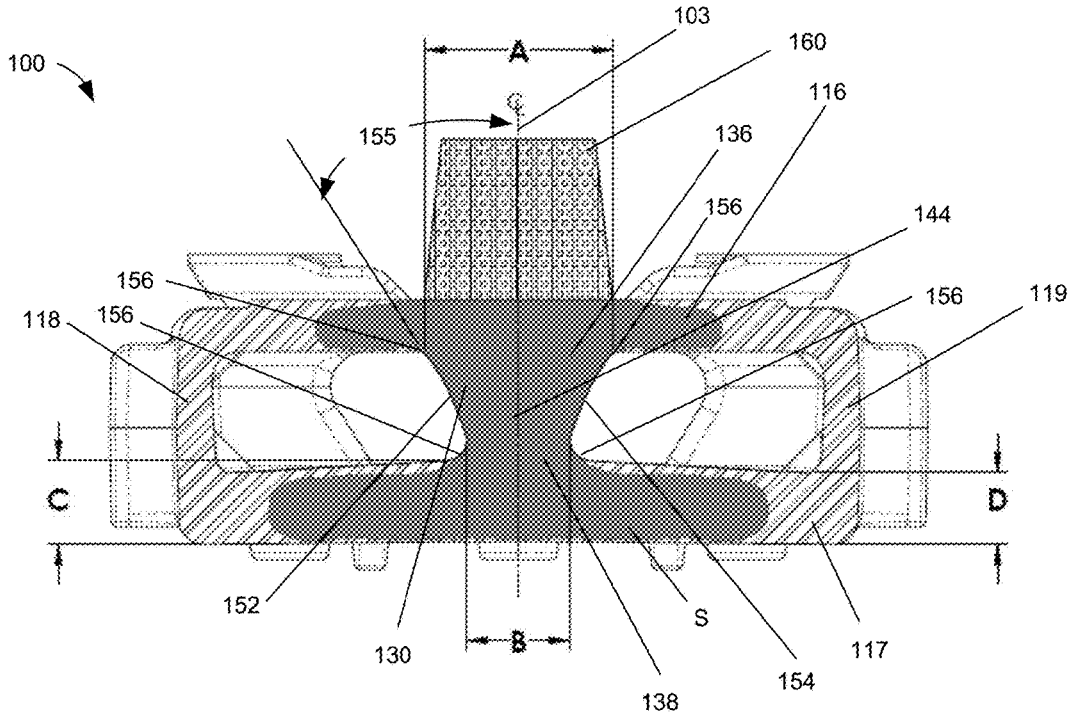
FIG. 7A illustrates a lateral cross-section of the exemplary bolster of FIG. 5 at dimension "I" along line 7A-7A.
Figure 8A:
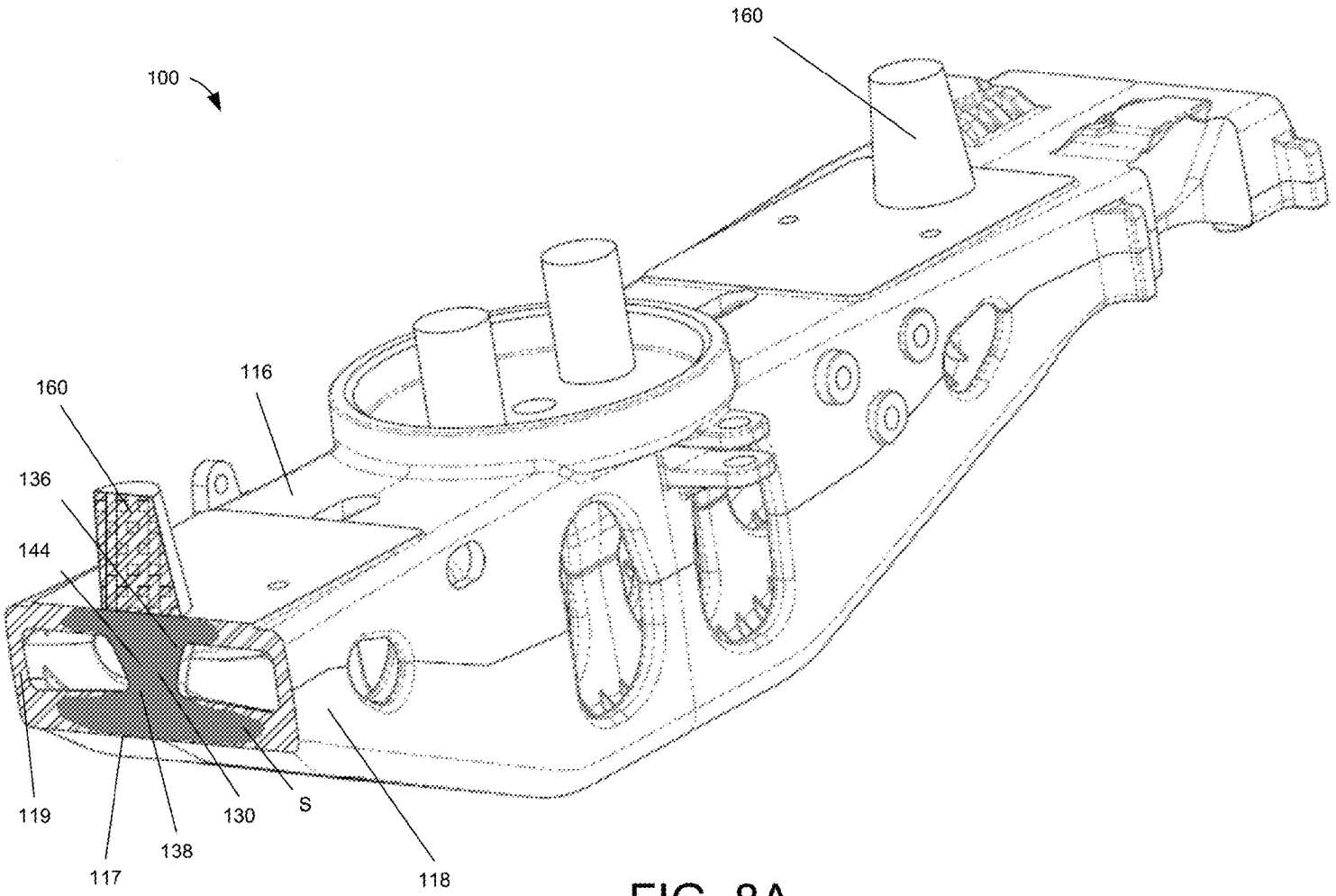
FIG. 8A illustrates a perspective view of the lateral cross-section of FIG. 7A.

FIGS. 7A and 8A illustrate a lateral cross-section through the center wall 130 at a location between the bowl portion 107 and the first end 104 at a location defined by the dimension "I," which is defined as the distance from the lateral centerline 103 of the bolster 100 to the location of the cross-section. Additionally, FIG. 7A is representative of a lateral cross-section taken through the center wall 130 at a location between the bowl portion 107 and the second end 105 location defined by the dimension "I." As described above, the center wall 130 may have a top portion 136, a bottom portion 138, a center portion 144, a front surface 152, and a back surface 154. The front surface 152 and back surface 154 may be positioned at an angle 155 relative to a longitudinal centerline 102 of the bolster 100. The angle 155 may be an acute angle formed between each of the front surface 152 and the rear surface 154 and the longitudinal centerline 102 of the bolster 100. Preferably, the angle 155 is formed such that the top portion 136 is wider than the bottom portion 138. Additionally, the front and rear surfaces 152, 154 may have a plurality of transition surfaces 156 located where the front and rear surfaces 152, 154 intersect the interior surfaces of the top wall 116 and the bottom wall 117. The transition surfaces 156 may allow for a smooth transition between the surfaces 152, 154 of the center wall 130 and the interior surfaces of the top wall 116 and bottom wall 117.

The top portion 136 of the center wall 130 may have a lateral thickness, dimension "A," defined as the distance from the intersection of the front surface 152 of the top portion 136 of the center wall 130 with the interior surface of the upper wall 116 and the intersection of the back surface 154 of the top portion 136 of the center wall 130 with the interior surface of the upper wall 116. Similarly, the bottom portion 138 may have a lateral thickness, dimension "B," defined as the distance from the intersection of the front surface 152 of the top portion 136 of the center wall 130 with the interior surface of the upper wall 116 and the intersection of the back surface 154 of the top portion 136 of the center wall 130 with the interior surface of the upper wall 116. The lateral thickness, dimension "A," of the top portion 136 of the center wall 130 may be greater than the lateral thickness, dimension "B," of the bottom portion 138 of the center wall 130. The tapered wall thickness provides additional strength along the top portion 136 of the center wall 130. Additionally, the lateral thickness may be expressed as a ratio of the top portion thickness, dimension "A," to the bottom portion thickness, dimension "B." The ratio of "A/B:1" may be within a range of 1.08:1 and 1.95:1 or alternatively, within the ranges disclosed below in Tables 1-3.

In addition, proximate or adjacent the location defined by the dimension "I," the bottom wall 117 may have a wall thickness that is variable. The thickness, dimension "C," may be defined as the thickness of the inner portion of the bottom wall 117, which is the distance from the interior surface of the bottom wall 117 near the intersection of the center wall 130 to the exterior surface of the bottom wall 117. The thickness, dimension "D," may be defined as the thickness of the outer portion of the bottom wall 117, which is a distance from the interior surface of the bottom wall 117 near the intersection of the either the front wall 118 or the back wall 119 to the exterior surface of the bottom wall 117. The bottom wall thickness may taper such that the inner portion thickness, dimension "C," near the intersection with the center wall 130 is greater than the outer portion thickness, dimension "D," near the front wall 118 or the back wall 119. Additionally, bottom wall thickness may be expressed as a ratio of the inner portion thickness, dimension "C," to the outer portion thickness, dimension "D." The ratio of "C/D:1" may be within a range of 1.05:1 and 2.46:1 or within the ranges disclosed below in Tables 1-3.

Figure 7B:
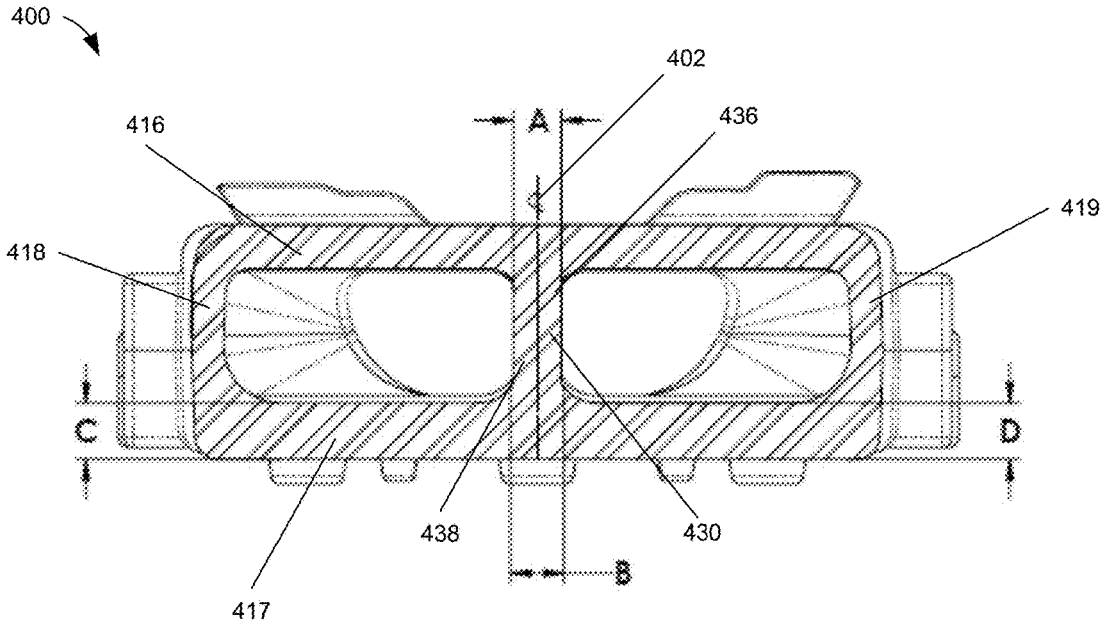
FIG. 7B illustrates a lateral cross-section of a prior art bolster.
Figure 8B:
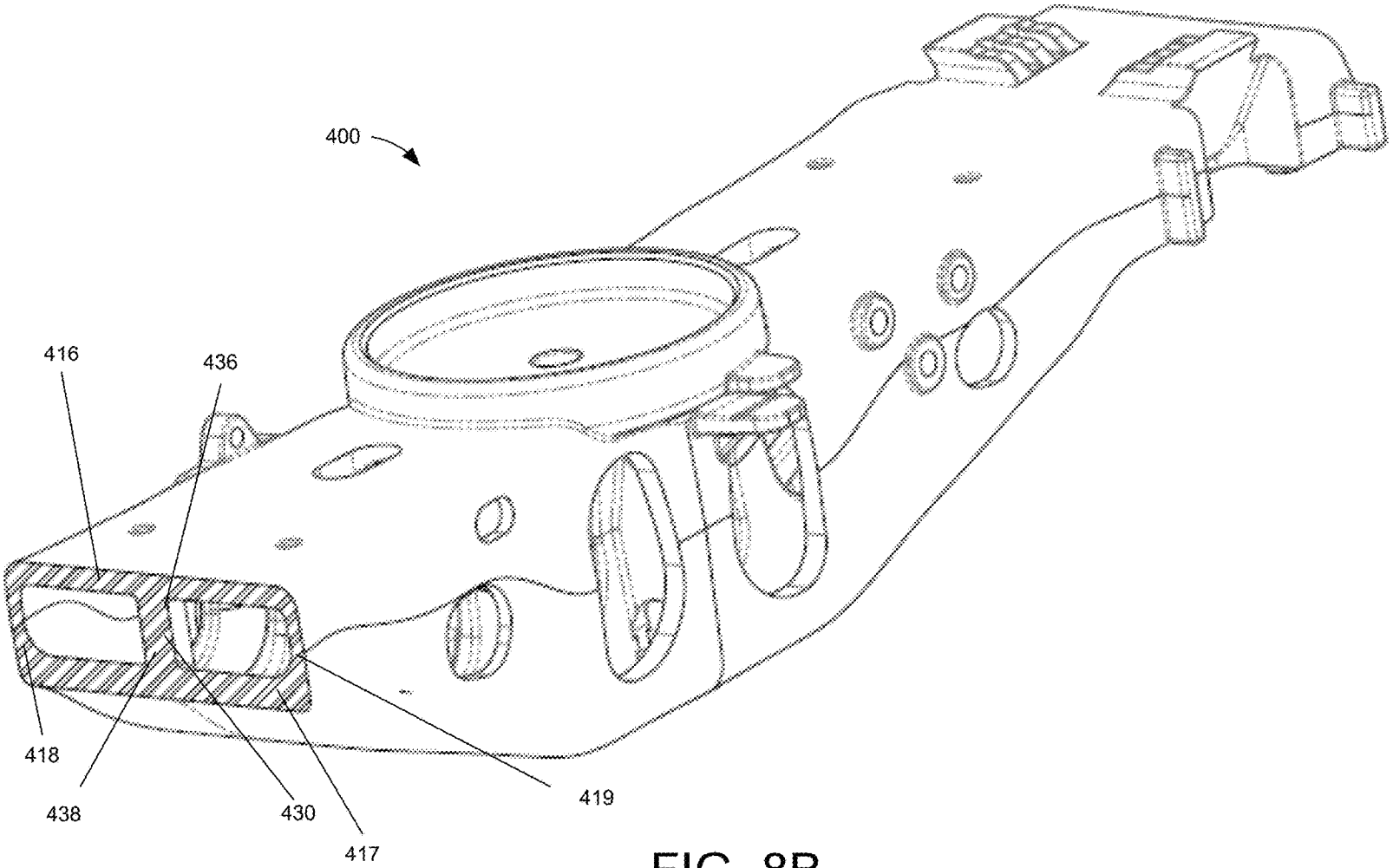
FIG. 8B illustrates a perspective view of the lateral cross-section of FIG. 7B.

When compared to a lateral cross-section of a prior art bolster 400 shown in FIGS. 7B and 8B, the differences become apparent as the center wall 430 of the prior art has a constant thickness where the top portion 436 of the center wall 430, dimension "A," is the same thickness as the bottom portion 438 of the center wall, dimension "B." Additionally, the bolster 400 also shows a constant thickness of bottom wall 417, where dimension "C" and dimension "D" are substantially equal.

Since the railway car trucks may have different weight capacities, the bolster 100 may be designed with different dimensions to be specifically sized for a variety of the truck capacities, such as a 70 ton capacity truck, a 110 ton capacity truck, and a 125 ton capacity truck. Example ranges for the dimensions described above for the bolster 100 in accordance with this disclosure are set forth in Table 1 below:

TABLE 1

Example Dimensional Ranges of Bolster 100

| | 70 TON CAPACITY TRUCK | | 110 TON CAPACITY TRUCK | | 125 TON CAPACITY TRUCK | |
|---|---|---|---|---|---|---|
| DIMENSION | min. (inches) | max. (inches) | min. (inches) | max. (inches) | min. (inches) | max. (inches) |
| A | 4.60 | 5.60 | 5.65 | 6.65 | 4.45 | 5.45 |
| B | 3.51 | 4.51 | 3.40 | 4.40 | 2.42 | 3.42 |
| C | 2.10 | 2.60 | 1.44 | 1.94 | 2.06 | 2.56 |
| D | 0.85 | 1.35 | 1.18 | 1.68 | 1.73 | 2.23 |
| E | 0.70 | 1.20 | 1.34 | 1.84 | 1.31 | 1.81 |
| F | 0.67 | 1.17 | 1.02 | 1.52 | 1.02 | 1.52 |
| G | 0.75 | 1.25 | 0.87 | 1.37 | 1.24 | 1.74 |
| H | 0.75 | 1.25 | 0.87 | 1.37 | 1.03 | 1.53 |
| I | 28.75 | 31.75 | 28.75 | 31.75 | 28.25 | 31.25 |
| Ratio of A/B:1 | 1.08 | 1.46 | 1.34 | 1.81 | 1.44 | 1.95 |
| Ratio of C/D:1 | 1.82 | 2.46 | 1.05 | 1.36 | 1.05 | 1.35 |

Table 1 above describes some general ranges of dimensions that may be used and characteristics that may be exhibited by some specific examples of the bolster 100 and in accordance with this disclosure. A bolster 100 need not have dimensions and characteristics that fall within all of the ranges identified for each capacity type in Table 1 to fall within the scope of this disclosure.

Table 2 below provides additional, more particular ranges of dimensions, at least some of which may be exhibited by at least some example bolsters 100 in accordance with this disclosure:

TABLE 2

Example Dimensional Ranges of Bolster 100

| | 70 TON CAPACITY TRUCK | | 110 TON CAPACITY TRUCK | | 125 TON CAPACITY TRUCK | |
|---|---|---|---|---|---|---|
| DIMENSION | min. (inches) | max. (inches) | min. (inches) | max. (inches) | min. (inches) | max. (inches) |
| A | 4.85 | 5.35 | 5.90 | 6.40 | 4.70 | 5.20 |
| B | 3.76 | 4.26 | 3.65 | 4.15 | 2.67 | 3.17 |
| C | 2.23 | 2.35 | 1.57 | 1.82 | 2.19 | 2.44 |
| D | 0.97 | 1.22 | 1.31 | 1.56 | 1.85 | 2.10 |
| E | 0.82 | 1.07 | 1.47 | 1.72 | 1.43 | 1.68 |
| F | 0.79 | 1.04 | 1.14 | 1.39 | 1.15 | 1.40 |
| G | 0.87 | 1.12 | 1.00 | 1.25 | 1.37 | 1.62 |
| H | 0.87 | 1.12 | 1.00 | 1.25 | 1.16 | 1.41 |
| I | 29.50 | 31.00 | 29.50 | 31.00 | 29.00 | 30.50 |
| Ratio of A/B:1 | 1.17 | 1.36 | 1.46 | 1.70 | 1.57 | 1.82 |
| Ratio of C/D:1 | 1.98 | 2.30 | 1.09 | 1.27 | 1.08 | 1.26 |

The various ranges provided in Table 2 are simply examples. A bolster 100 need not have dimensions or characteristics that satisfy all of these identified ranges to fall within the scope of this disclosure.

Table 3 provides even more targeted dimensions and characteristics of a bolster 100 in accordance with a specific example of this disclosure. Of course, a bolster 100 need not have these specific dimensions and/or characteristics to fall within the scope of this disclosure.

TABLE 3

Example Dimensional Ranges of Bolster 100

| DIMENSIONS | 70 TON CAPACITY TRUCK (inches) | 110 TON CAPACITY TRUCK (inches) | 125 TON CAPACITY TRUCK (inches) |
|---|---|---|---|
| A | 5.1 | 6.2 | 5.0 |
| B | 4.0 | 3.9 | 2.9 |
| C | 2.4 | 1.7 | 2.3 |
| D | 1.1 | 1.4 | 2.0 |
| E | 1.0 | 1.6 | 1.6 |
| F | 0.9 | 1.3 | 1.3 |
| G | 1.0 | 1.1 | 1.5 |
| H | 1.0 | 1.1 | 1.3 |
| I | 30.25 | 30.25 | 29.75 |
| Ratio of A/B:1 | 1.27 | 1.58 | 1.70 |
| Ratio of C/D:1 | 2.14 | 1.18 | 1.17 |

While specific dimensions, characteristics, and/or ranges of dimensions and characteristics are set forth in the various tables above, those skilled in the art will recognize that these dimensions and ranges are examples that may be used in at least some examples of this disclosure. Many variations in the ranges and the specific dimensions and characteristics may be used without departing from this disclosure.

While various embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

The invention claimed is:

1. A bolster for a railway car truck, the bolster comprising:

a top wall, a bottom wall, a front wall, and a back wall;

a first pair of shoe pockets at a first end of the bolster, the first pair of shoe pockets configured to be inserted into a bolster opening of a first side frame;

a second pair of shoe pockets at a second end of the bolster, the second pair of shoe pockets configured to be inserted into a bolster opening of a second side frame;

a first center wall positioned toward the first end and engaged with the top wall and the bottom wall, and substantially centered between the front wall and the back wall;

a second center wall positioned toward the second end and engaged with the top wall and the bottom wall, and substantially centered between the front wall and the back wall;

a pair of brake window openings defined in the front and back walls by brake window walls;

a pair of lightener windows defined in the front and back walls by lightener window walls;

a bowl portion defined in a center of the bolster;

wherein a thickness of a top portion of the first center wall is greater than a thickness of a bottom portion of the first center wall proximate a first location between the bowl portion and the first end;

wherein a thickness of a top portion of the second center wall is greater than a thickness of a bottom portion of the second center wall proximate a second location between the bowl portion and the second end;

wherein the first location is arranged between about 28.75 inches and 31.75 inches toward the first end from the center of the bolster;

wherein the second location is arranged between about 28.75 inches and 31.75 inches toward the second end from the center of the bolster;

wherein a ratio of the thickness of an inner portion of the bottom wall proximate the first location to the thickness of an outer portion of the bottom wall proximate the first location is between about 1.82:1 and 2.46:1; and wherein a ratio of the thickness of an inner portion of the bottom wall proximate the second location to the thickness of an outer portion of the bottom wall proximate the second location is between about 1.82:1 and 2.46:1.

2. The bolster of claim 1, wherein a thickness of a top portion of the first center wall proximate the first location is between about 4.60 inches and 5.60 inches and the thickness of the bottom portion of the first center wall proximate the first location is between about 3.51 inches and 4.51 inches; and wherein a thickness of a top portion of the second center wall proximate the second location is between about 4.60 inches and 5.60 inches and the thickness of the bottom portion of the second center wall proximate the second location is between about 3.51 inches and 4.51 inches.

3. The bolster of claim 1, wherein a ratio of the thickness of a top portion of the first center wall proximate the first location to the thickness of the bottom portion of the first center wall proximate the first location is between about 1.08:1 and 1.46:1; and wherein the ratio of the thickness of a top portion of the second center wall proximate the second location to the thickness of the bottom portion of the second center wall proximate the second location is between about 1.08:1 and 1.46:1.

4. The bolster of claim 1, wherein a thickness of a top portion of the first center wall proximate the first location is between about 5.65 inches and 6.65 inches and the thickness of the bottom portion of the first center wall proximate the first location is between about 3.40 inches and 4.40 inches; and wherein a thickness of a top portion of the second center wall proximate the second location is between about 5.65 inches and 6.65 inches and the thickness of the bottom portion of the second center wall proximate the second location is between about 3.40 inches and 4.40 inches.

5. The bolster of claim 1, wherein a ratio of the thickness of a top portion of the first center wall proximate the first location to the thickness of the bottom portion of the first center wall proximate the first location is between about 1.34:1 and 1.81:1; and wherein the ratio of the thickness of a top portion of the second center wall proximate the second location to the thickness of the bottom portion of the second center wall proximate the second location is between about 1.34:1 and 1.81:1.

6. The bolster of claim 1, wherein a thickness of an inner portion of the bottom wall proximate the first location is greater than the thickness of an outer portion of the bottom wall proximate the first location; and wherein a thickness of an inner portion of the bottom wall proximate the second location is greater than the thickness of an outer portion of the bottom wall proximate the second location.

7. The bolster of claim 1, wherein a thickness of an inner portion of the bottom wall proximate the first location is between about 2.10 inches and 2.60 inches and the thickness of an outer portion of the bottom wall proximate the first location is between about 0.85 inches and 1.35 inches; and wherein a thickness of an inner portion of the bottom wall proximate the second location is between about 2.10 inches and 2.60 inches and the thickness of an outer portion of the bottom wall proximate the second location is between about 0.85 inches and 1.35 inches.

8. A bolster for a railway car truck, the bolster comprising:

a top wall, a bottom wall, a front wall, and a back wall;

a first pair of shoe pockets at a first end of the bolster, the first pair of shoe pockets configured to be inserted into a bolster opening of a first side frame;

a second pair of shoe pockets at a second end of the bolster, the second pair of shoe pockets configured to be inserted into a bolster opening of a second side frame;

a first center wall positioned toward the first end and engaged with the top wall and the bottom wall, and substantially centered between the front wall and the back wall;

a second center wall positioned toward the second end and engaged with the top wall and the bottom wall, and substantially centered between the front wall and the back wall;

a pair of brake window openings defined in the front and back walls by brake window walls;

a pair of lightener windows defined in the front and back walls by lightener window walls;

a bowl portion defined in a center of the bolster;

wherein a thickness of a top portion of the first center wall is greater than a thickness of a bottom portion of the first center wall proximate a first location between the bowl portion and the first end;

wherein a thickness of a top portion of the second center wall is greater than a thickness of a bottom portion of the second center wall proximate a second location between the bowl portion and the second end;

wherein the first location is arranged between about 28.25 inches and 31.25 inches toward the first end from the center of the bolster;

wherein the second location is arranged between about 28.25 inches and 31.25 inches toward the second end from the center of the bolster;

wherein a ratio of the thickness of an inner portion of the bottom wall proximate the first location to the thickness of an outer portion of the bottom wall proximate the first location is between about 1.05:1 and 1.35:1; and wherein a ratio of the thickness of an inner portion of the bottom wall proximate the second location to the thickness of an outer portion of the bottom wall proximate the second location is between about 1.05:1 and 1.35:1.

9. The bolster of claim 8, wherein a thickness of a top portion of the first center wall proximate the first location is between about 4.45 inches and 5.45 inches and the thickness of the bottom portion of the first center wall proximate the first location is between about 2.42 inches and 3.42 inches; and wherein a thickness of a top portion of the second center wall proximate the second location is between about 4.45 inches and 5.45 inches and the thickness of the bottom portion of the second center wall proximate the second location is between about 2.42 inches and 3.42 inches.

10. The bolster of claim 8, wherein a ratio of the thickness of a top portion of the first center wall proximate the first location to the thickness of the bottom portion of the first center wall proximate the first location is between about 1.44:1 and 1.95:1; and wherein the ratio of the thickness of a top portion of the second center wall proximate the second location to the thickness of the bottom portion of the second center wall proximate the second location is between about 1.44:1 and 1.95:1.

11. The bolster of claim 8, wherein a thickness of an inner portion of the bottom wall proximate the first location is between about 2.06 inches and 2.56 inches and the thickness of an outer portion of the bottom wall proximate the first location is between about 1.73 inches and 2.23 inches; and wherein a thickness of an inner portion of the bottom wall proximate the second location is between about 2.06 inches and 2.56 inches and the thickness of an outer portion of the bottom wall proximate the second location is between about 1.73 inches and 2.23 inches.

12. A bolster for a railway car truck, the bolster comprising:

a top wall, a bottom wall, a front wall, and a back wall;

a first pair of shoe pockets at a first end of the bolster, the first pair of shoe pockets configured to be inserted into a bolster opening of a first side frame;

a second pair of shoe pockets at a second end of the bolster, the second pair of shoe pockets configured to be inserted into a bolster opening of a second side frame;

a first center wall positioned toward the first end and engaged with the top wall and the bottom wall, and substantially centered between the front wall and the back wall;

a second center wall positioned toward the second end and engaged with the top wall and the bottom wall, and substantially centered between the front wall and the back wall;

a pair of brake window openings defined in the front and back walls by brake window walls;

a pair of lightener windows defined in the front and back walls by lightener window walls;

a bowl portion defined in a center of the bolster;

wherein a thickness of a top portion of the first center wall is greater than a thickness of a bottom portion of the first center wall proximate a first location between the bowl portion and the first end;

wherein a thickness of a top portion of the second center wall is greater than a thickness of a bottom portion of the second center wall proximate a second location between the bowl portion and the second end;

wherein the first location is arranged between about 28.75 inches and 31.75 inches toward the first end from the center of the bolster;

wherein the second location is arranged between about 28.75 inches and 31.75 inches toward the second end from the center of the bolster;

wherein a ratio of the thickness of an inner portion of the bottom wall proximate the first location to the thickness of an outer portion of the bottom wall proximate the first location is between about 1.05:1 and 1.36:1; and wherein a ratio of the thickness of an inner portion of the bottom wall proximate the second location to the thickness of an outer portion of the bottom wall proximate the second location is between about 1.05:1 and 1.36:1.

13. The bolster of claim 12, wherein a thickness of an inner portion of the bottom wall proximate the first location is between about 1.44 inches and 1.94 inches and the thickness of an outer portion of the bottom wall proximate the first location is between about 1.18 inches and 1.68 inches; and wherein a thickness of an inner portion of the bottom wall proximate the second location is between about 1.44 inches and 1.94 inches and the thickness of an outer portion of the bottom wall proximate the second location is between about 1.18 inches and 1.68 inches.

14. A bolster for a railway car truck, the bolster comprising:

a top wall, a bottom wall, a front wall, a back wall;

a first pair of shoe pockets at a first end of the bolster, the first pair of shoe pockets configured to be inserted into a bolster opening of a first side frame;

a second pair of shoe pockets at a second end of the bolster, the second pair of shoe pockets configured to be inserted into a bolster opening of a second side frame;

a first center wall positioned toward the first end and engaged with the top wall and the bottom wall, and substantially centered between the front wall and the back wall;

a second center wall positioned toward the second end and engaged with the top wall and the bottom wall, and substantially centered between the front wall and the back wall;

a pair of brake window openings defined in the front and back walls by brake window walls;

a pair of lightener windows defined in the front and back walls by lightener window walls;

a bowl portion defined in a center of the bolster;

wherein a thickness of a top portion of the first center wall is greater than a thickness of a bottom portion of the first center wall;

wherein a thickness of a top portion of the second center wall is greater than a thickness of a bottom portion of the second center wall;

wherein a thickness of the bottom wall adjacent the first center wall is greater than the thickness of the bottom wall adjacent the front wall and the back wall; and wherein a thickness of the bottom wall adjacent the second center wall is greater than the thickness of the bottom wall adjacent the front wall and the back wall; and wherein a ratio of the thickness of the bottom wall adjacent the first center wall to the thickness of the bottom wall adjacent the front wall and the back wall is between about 1.05:1 and 2.46:1; and wherein a ratio of the thickness of the bottom wall adjacent the second center wall to the thickness of the thickness of the bottom wall adjacent the front wall and the back wall is between about 1.05:1 and 2.46:1.

15. The bolster of claim 14, wherein a ratio of the thickness of the top portion of the first center wall to the thickness of the bottom portion of the first center wall is between about 1.08:1 and 1.95:1; and wherein a ratio of the thickness of the top portion of the second center wall to the thickness of the bottom portion of the second center wall is between about 1.08:1 and 1.95:1.

* * * * *